United States Patent [19]

O'Brien

[11] Patent Number: 4,725,394

[45] **Date of Patent: * Feb. 16, 1988**

[54] PROCESS FOR PREPARING HIGH STENGTH CELLULOSIC FIBERS

[75] Inventor: John P. O'Brien, Wilmington, Del.

[73] Assignee: E. I. Du Pont de Nemours and Company, Wilmington, Del.

[ * ] Notice: The portion of the term of this patent subsequent to Aug. 7, 2001 has been disclaimed.

[21] Appl. No.: 702,844

[22] Filed: Feb. 19, 1985

[51] Int. Cl.[4] ..... D01D 5/06; D01F 2/28

[52] U.S. Cl. ..... 264/187; 264/200; 264/207; 264/211.16; 106/196

[58] Field of Search ..... 264/200, 187, 207, 211.16; 106/163.1, 165, 169, 196

[56] References Cited

U.S. PATENT DOCUMENTS

| | | | |
|---|---|---|---|
| Re. 30,352 | 7/1980 | Kwolek | 524/422 |
| 1,521,876 | 1/1925 | Farrow | 106/196 |
| 1,943,461 | 1/1934 | Traill et al. | 536/88 |
| 4,370,168 | 1/1983 | Kamide et al. | 106/177 |
| 4,464,323 | 8/1984 | O'Brien | 264/187 |

FOREIGN PATENT DOCUMENTS

| | | | |
|---|---|---|---|
| 2340344 | 6/1983 | France | 264/187 |

*Primary Examiner*—Jan H. Silbaugh
*Assistant Examiner*—Hubert C. Lorin

[57] ABSTRACT

High strength, high modulus cellulose triacetate fibers are produced by spinning a 30–50% by weight solution of cellulose triacetate having an acetyl content of at least 42.5% and an inherent viscosity of at least 5 from a solvent mixture comprising nitric acid and another solvent having a molecular weight of less than 160 in a mol ratio of 1–3 through an air gap into a coagulating bath.

6 Claims, 2 Drawing Figures

ALL OBSERVATIONS AT ROOM TEMPERATURE

TERNARY PHASE DIAGRAM

CELLULOSE TRIACETATE/NITRIC ACID/WATER

PROCESS FOR PREPARING HIGH STENGTH CELLULOSIC FIBERS

This invention concerns a new process for making cellulose triacetate fiber from optically anisotropic solutions of cellulose triacetate.

BACKGROUND OF THE INVENTION

Anisotropic spinning solutions from aromatic polyamides have been described in Kwolek U.S. Pat. No. 3,671,542 and U.S. Pat. No. Re. 30,352. These solutions (dopes) are useful in making aramid fibers of very high tenacity and modulus.

Optically anisotropic solutions of cellulosic materials have been described in French Pat. No. 2,340,344, and these too have provided high tenacity/high modulus fibers. The ever-increasing costs of petrochemicals gives increasing impetus to the study of fibers from renewable sources, such as the cellulosics. In particular cellulosic fibers with properties approaching the aramid properties have been sought. Considerable effort has been applied to the use of optically anisotropic solutions to obtain the desired properties.

In the cellulose textile field it has been proposed that higher DP (degree of polymerization) should provide improved properties in the resulting fibers or films but it has not been possible to accomplish this goal because of the extremely high viscosity of the solutions. Anisotropic solutions provide the opportunity for spinning at high concentrations without excessive viscosities.

Dissolution of cellulosic polymers can be quite rapid in strong inorganic acids like sulfuric acid, nitric acid, phosphoric acid, and hydrochloric acid and severe molecular weight loss and competitive esterification reactions have rendered such solvent systems of limited utility for the preparation of high performance shaped articles. U.S. Pat. Nos. 1,521,876 (Farrow), 1,943,461 (Traill), and 4,370,168 (Kamide) are illustrative of those describing the utility of a variety of aqueous inorganic acids in degrading cellulosics to lower molecular weight or to alter the type and distribution of substituent groups on the backbone through hydrolysis or esterification.

U.S. Pat. No. 4,370,168 further describes cellulose derivative materials dissolved in an aqueous solution of inorganic acid, but prior to the present invention, adequate inorganic solvents for forming high concentration solutions of high DP cellulose triacetate have not been available. Additionally, the solvents of this invention give rise to cellulose triacetate mesophase solutions which are uniquely resistant to chain scission and substituent hydrolysis. This enhanced stability is the result of using cellulose triacetate, high solids solutions and the greatly decreased hydrolyzing power of the specific solvent mixtures described. The ability to dissolve and maintain high polymer molecular weight and prevent esterification by the nitric acid in high concentration mesophase systems is an essential feature and has resulted in the preparation of fibers or other shaped articles with far superior mechanical properties versus those described previously from inorganic solvents.

SUMMARY OF THE INVENTION

The invention provides a process for producing a high strength cellulose triacetate fiber by air-gap spinning an optically anisotropic solution comprising (1) 30 to 50% by weight of cellulose triacetate having an inherent viscosity in hexafluoroisopropanol at 0.5 g/dl of at least 5 and a degree of substitution equivalent to at least 42.5% by weight acetyl groups and (2) 50 to 70% by weight of a solvent mixture comprised of nitric acid and another solvent having a molecular weight less than 160, the molar ratio of the inorganic acid to the other solvent preferably methylene chloride or water being from 1 to 3, the anisotropic solution being spun through an inert noncoagulating fluid layer into a bath preferably comprising water, a one-to-three-carbon alcohol or diol, preferably methanol or a mixture of the two. The coagulated yarn from the bath is then washed in water or methanol to extract remaining solvent and then dried.

The fibers can be optionally heat treated under tension or saponified to provide high strength, high modulus regenerated cellulose fibers.

The fibers are useful in ropes and cordage, tire cords and other uses requiring high tensile strength and high modulus.

THE DRAWINGS

TESTS

Figure 1:
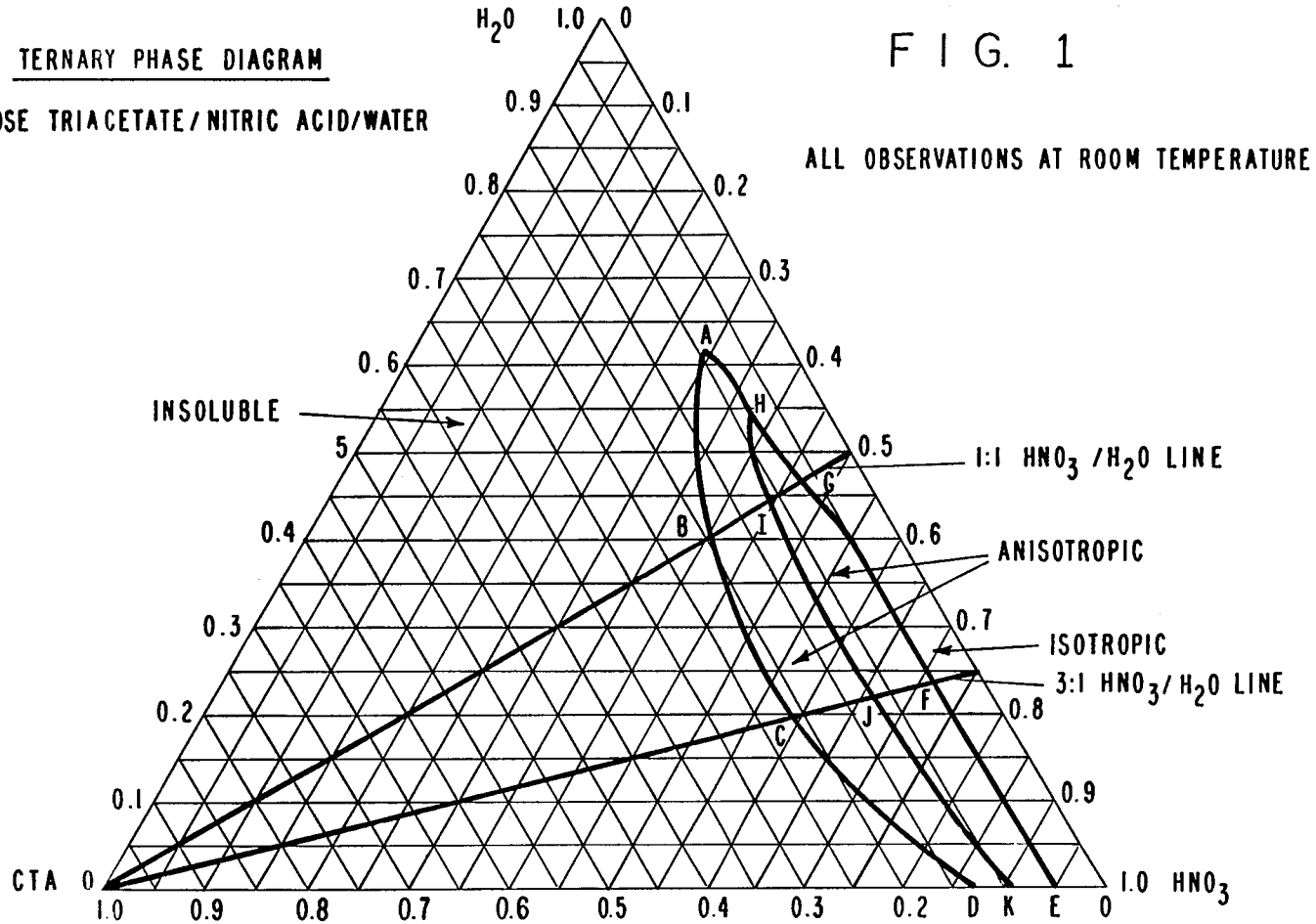
FIG. 1 is a ternary phase diagram constructed for the systems comprising cellulose triacetate/nitric acid/water.

Inherent viscosity is calculated using the formula:

$$\text{Inherent viscosity, } \eta_{inh} = \frac{\ln \eta_{rel}}{C} \text{ where } C$$

is the polymer concentration in grams polymer per deciliter of solvent. The relative viscosity ($\eta_{rel}$) is determined by measuring the flow time in seconds using a standard viscometer of a solution of 0.5 g of the polymer in 100 ml. hexafluoroisopropanol at 30° C. and dividing by the flow time in seconds for the pure solvent. The units of inherent viscosity are dl/g.

Acetyl content of cellulose acetate is determined by ASTM method D-871-72 (reapproved 1978) Method B. part 21, 1982.

Filament tensile properties were measured using a recording stress-strain analyzer at 70° F. (21.1° C.) and 65% relative humidity. Gauge length was 1.0 in (2.54 cm), and rate of elongation was 10%/min. Results are reported as T/E/M, T is break tenacity in dN/tex, E is elongation-at-break expressed as the percentage by which initial length increased, and M is initial tensile modulus in dN/tex. Average tensile properties for three to five filament samples are reported. The test is further described in ASTM D2101-79 part 33, 1981.

The tex of a single filament is calculated from its fundamental resonant frequency, determined by vibrating a 2.0 to 4.1 cm. length of fiber under tension with changing frequency (A.S.T.M. D1577-79, part 33, 1981). This filament is then used for 1 break.

MEASUREMENT OF APPARENT AXIAL CRYSTALLITE SIZE (AACS)

AACS is obtained from the meridional X-ray profile of the fiber. An automatic 2 theta diffractometer, manufactured by Philips Electronic Instruments, is used in the transmission mode with single crystal monochromatized $CuK_\alpha$ radiation. The generator is operated at 40 kV and 40 mA. The diffractometer is equipped with 1 degree divergence and receiving slits.

About 2 meters of fibers are wound on a specimen holder so that all the filaments are parallel to each other. The thickness of the layer so obtained does not exceed 0.5 mm.

The diffracted intensity is digitally recorded between approximately 14 and 20 degrees of 2 theta by steps of 0.025 degree. The raw intensity data is then corrected for Lorentz and polarization effects (correction factor is $\sin 2\theta/(1+\cos^2 2\theta)$ and smoothed by use of a standard polynomial smoothing routine (see for example J. Steiner et al., Analytical Chemistry, 44, 1906 (1972)).

The resulting profile for fibers of the present invention exhibits a peak at about 17.2 to 17.6 degrees of 2 theta. The peak may be asymmetrical because of off-meridional contributions to the profile.

A deconvolution computer routine, similar to those described in the literature (see for example A. M. Hindeleh and D. J. Johnson, Polymer 13, 27 (1972)) is used to resolve the smoothed profile into a baseline and either a single diffraction peak, if the experimental peak is symmetrical or a main peak and a background peak, if not.

The theoretical peaks are calculated as a linear combination of Gaussian and Cauchy profiles. The peak(s) position, height and width at half-height are adjusted for best fit to the experimental profile. The fractions of Gaussian and Cauchy components are fixed and taken as 0.6 and 0.4, respectively for the main peak at about 17.2 to 17.6 degrees of 2 theta, and 0.4 and 0.6, respectively for the background peak (if needed). The base line is initially defined as the straight line joining the intensity points at about 14.3 and 19.1 degrees of 2 theta. It is slightly adjusted in the refinement but kept straight.

The AACS is obtained from the width at half-height, B (radians), of the main peak at about 17.2 to 17.6 degrees of 2 theta as refined by the deconvolution routine:

$$AACS=\lambda\cos\theta(B^2-b^2)^{\frac{1}{2}}$$

This is the classical Scherrer equation with a shape factor taken as unity. Other parameters in the equation are:

the wavelength of the X-ray radiation, $\lambda=1.5418$ Å the diffraction angle, $2\theta$, taken as 17.5° the instrumental broadening, b (radians); it is measured as the breadth (at half-height) of the peak at 28.5 degrees of 2 theta of a silicon powder standard provided by the manufacturer.

DIFFERENTIAL SCANNING CALORIMETER (DSC) TEST

A "Du Pont 1090 Thermal Analyzer" differential scanning calorimeter is used, run at 20° C. per minute from room temperature to 400° C. The sample size is about 10 mg and the instrument is calibrated with Indium metal. Heats are directly obtained from the instrument software after selection of a proper baseline for the peak of interest.

As-spun fibers of the present invention exhibit a well defined crystallization exotherm at a temperature between 190° C. and 250° C. Heat-treated fibers on the contrary exhibit a flat trace, no peak corresponding to a heat exchange greater than 0.5 Joule/gram being detected in this region.

Activation Procedure

In order to reduce unwanted chain scission, cellulose activation is preferably carried out under mild conditions as shown in Table 1 which permits acetylation at low temperatures, providing cellulose triacetate with inherent viscosities above 5.0 from cotton linters or combed cotton. Although cellulose preactivation was not necessarily required for high temperature acetylation reactions (40°–80° C.) it was found to be essential for success at low temperatures.

In a preactivation process, a 4-l resin kettle was charged with 3 l of distilled water and 100 grams of cotton linters. A reflux condensor was added and the mixture was heated to boiling under a nitrogen atmosphere. Heat was removed from the kettle 5 hours after boiling had begun. The kettle was allowed to cool for ~30 minutes, whereupon the linters were recovered by suction filtration onto cheesecloth. The excess water was pressed out under vacuum with a rubber diaphragm. The linters were placed in a stainless steel beaker equipped with an eggbeater stirrer and then covered with methanol. After stirring at room temperature for 30 minutes, the linters were filtered and pressed. The methanol soak was repeated, followed by two similar treatments with methylene chloride. Linters (damp with methylene chloride) thus activated were used directly or kept in a tightly sealed container for later use.

Several alternative activation processes have been found to be useful.

Illustrative Acetylation Procedure

For the acetylation process a 4-l resin kettle fitted with a Hastelloy C eggbeater type stirrer and a thermocouple was charged with acetic anhydride, 1 l; glacial acetic acid, 690 ml; and methylene chloride; 1020 ml. The reactants were cooled externally to −25° to −30° C. using a solid carbon dioxide/Acetone bath and the pre-activated cellulose was added. The reactants were then chilled to −40° C. in preparation for catalyst addition.

Acetic anhydride, 450 ml, was chilled to −20° to −30° C. in a 1 l erlenmeyer flask containing a magnetic stirring bar. Perchloric acid (60% aqueous solution, 10 ml) was added dropwise over 5–10 minutes with vigorous stirring while keeping the temperature below −20° C. Because of the strong oxidizing capability of perchloric acid in the presence of organic matter the catalyst solutions should be made and used at low temperature.

The catalyst solution was poured in a steady stream into the vigorously stirring slurry at −40° C. After addition was complete and the catalyst thoroughly dispersed the reactants were allowed to warm to −20° to −25° C. with stirring. At these temperatures the reaction was slow and it was difficult to detect an exotherm. However within 2–6 h the consistency of the slurry changed and the pulp began to swell and break up. After stirring for 4–6 h the reaction vessel was transferred to a freezer at −15° C. and allowed to stand overnight. By morning the reactants had assumed the appearance of a thick, clear gel which on stirring behaved as a typical non-Newtonian fluid (climbed the stirrer shaft). At this time a small sample was precipitated by pouring into methanol (at −20° C.) using a high speed electric blender with a nitrogen purge and then collected by suction filtration. A small portion was blotted to remove excess methanol and checked for solubility in methylene chloride or 100% trifluoroacetic acid. The absence of solution gel particles after 5–10 minutes indicated that reaction was complete and that the bulk polymer was ready for workup. Additionaly a portion of the reaction mixture was examined microscopically between crossed polarizers for the possible presence of unreacted fibers which appeared as discrete birefringent domains. If the reaction was not complete the reactants were allowed to stir at −15° to −20° C. and checked every hour for solubility until clear solutions were obtained.

The thick, clear solution was then precipitated batchwise into cold methanol (6 l at −20° C.) using a high speed blender. The highly swollen particles were filtered onto two layers of cheesecloth using suction and pressed out. The resultant mat was then broken up and immersed in acetone (3 l) for a few minutes and then pressed out in order to remove any residual methylene chloride. The white flake was subsequently washed during the following sequence:

4 l 5% sodium Bicarbonate, once,
4 l Water, twice,
3 l Acetone, twice

The product was then placed in shallow pans and allowed to dry in air overnight. Yields were 150–170 g.

Properties of triacetate polymer prepared at low temperature are shown in Table 1. The above process provides cellulose triacetate with at least 42.5% by weight of acetyl groups, preferably at least 44% (theoretical value 44.8%) and is representative of the low temperature reaction procedures employing either homogeneous or heterogeneous acetylation media for the polymers of this invention.

TABLE 1

| | | ACTIVATION METHOD | REACTION TEMPERATURE (°C.) | $\eta_{inh}$ | % Acetyl |
|---|---|---|---|---|---|
| A | Cotton Linters | Boil 2 h in water | −45 to −5 | 6.4 | 44.2 |
| B | Cotton Linters | Boil 2 h in water | −27 to −17* | 8.0 | 42.7 |
| C | Combed Cotton | Extract with ethanol, Boil 12 h 1% NaOH, Wash, Neutralize 1% acetic acid | −17 to +12** | 5.1 | 44.2 |
| D | Cotton Linters | Boil 5 h in water | −24 to −8* | 7.4 | 43.6 |
| E | Cotton Linters | Boil 1 h in water | −32 to +5 | 5.2 | 40.2 |

*heterogeneous acetylation, toluene present in acetylation medium
**briefly

Preparation of Anisotropic Spin Dopes

High solids spinning solutions of cellulose triacetate in aqueous nitric acid were prepared below room temperature in an Atlantic Research Corporation Model 2CV Helicone Mixer/Reactor. Typically the procedure involved chilling the acid (contained in a resin kettle) to about −10° C. and slowly adding freshly dried triacetate flake. Dissolution is exothermic and care was taken to keep the contents of the resin kettle below room temperature throughout the addition. When approximately two thirds of the flake had been added, and the polymer thoroughly wetted by mixing with a stainless steel spatula, the highly viscous mass was transferred to the motorized mixer. The mixing bowl was chilled to ~0° C. using an external refrigeration unit and mixing started. While monitoring the temperature in the mixing bowl the remaining polymer flake was added slowly, being careful to prevent the formation of any large chunks of dry polymer. Depending on spin dope concentration, the mixer would occasionally stall at 0° C., and in some cases it was necessary to allow the contents to warm to room temperature. At this point mixing could be reinitiated and, in general, acceptable mixing achieved under these conditions. In an effort to minimize any unwanted degradion prior to spinning, solution preparation was carried out immediately before spinning. Generally, the solutions were mixed 2–4 hours after addition of the polymer flake had been completed. After confirming that dissolution was complete by microscopic examination, the dope was transferred to a stainless steel spinning cell.

Solution Preparation

The FIG. 1 shows an area wherein optically anisotropic solutions are available with solvent mixtures of certain compositions. The figure further shows areas within the anisotropic area within which fibers having high tenacity and modulus are accessible.

The diagram was constructed using qualitative observations to determine solubility. The homogeneous solutions were judged anisotropic if samples sandwiched between a microscope slide and cover slip were birefringent when viewed between crossed polarizers. All observations were taken at room temperature after mixing the solutions and allowing them to stand for up to 24 hours. A sample was classified as borderline if greater than about 80–90% of the polymer was in solution, but microscopic examination revealed some incompletely dissolved particles. The areas bounded by points ABCDEFGH are regions of complete solubility which are anisotropic. BCFG encloses areas of solution composition suitable for use in the present invention. The axes are graduated directly in mole fractions so that for any point on the diagram molar ratios can be determined. Moles of cellulose triacetate are calculated in terms of glucose triacetate (GTA) repeat units (unit weight=288.25).

It is apparent from FIG. 1 that there is a well defined compositional range over which anisotropic solutions are obtained. Maximum polymer solubility is achieved at a $HNO_3/H_2O$ ratio of about 2. For Eastman 2314 triacetate this corresponds to mole fractions $HNO_3$:$H_2O$:GTA of 0.52:0.26:0.22 or 63 wt. % cellulose triacetate with respect to the total solution weight based on glucose triacetate repeating units.

It should be recognized the cellulose triacetate solubility is stongly dependent on polymer molecular weight, hence the shape and position of the anisotropic region is related to polymer inherent viscosity. Maximum triacetate solubility shows a decreasing trend as molecular weight increases and the area bounded by points EFGHIJK is representative of the solubility attainable when polymer inherent viscosity is greater than 5. In addition, the minimum concentration necessary for incipient mesophase formation shifts to lower concentrations with increasing molecular weight. Hence, while it is possible to achieve triacetate mesophase solutions at up to 63 wt. % with Eastman 2314 ($\eta_{inh}=3.9$) cellulose triacetate, polymers with $\eta_{inh}\geqq 5$ exhibited maximum solubility in the range of 45–50 wt. %.

In practice optimum spinnability and the desired fiber properties were obtained using 35 to 40% solids CTA solutions in $HNO_3/H_2O$ at molar ratios of 1-3. In the figure, a solvent molar ratio of 1 appears as line BG which represents an $HNO_3$ mole fraction of 0.50 and a solvent molar ratio of 3 appears as line CF which represents an $HNO_3$ mole fraction of 0.75 with respect to the solvent alone.

Spinning

Figure 2:
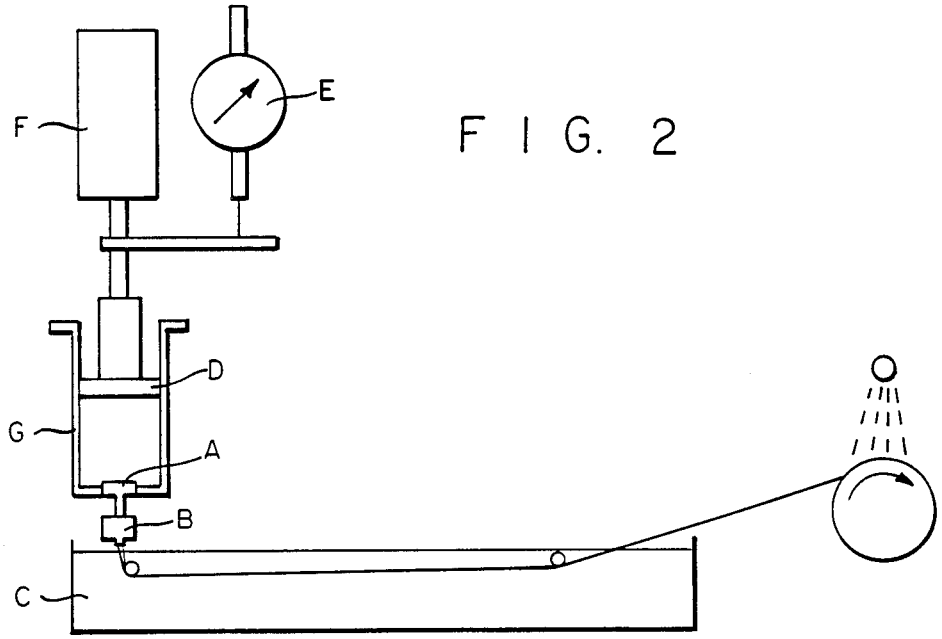
FIG. 2 is a schematic diagram of apparatus for air-gap spinning of anisotropic solutions of cellulose triacetate.

High solids, anisotropic solutions of cellulose triacetate were air-gap-spun into cold water or water and methanol mixtures using apparatus shown in FIG. 2. A piston (D) activated by hydraulic press (F) and associated with piston travel indicator (E) was positioned over the surface of the dope, excess air expelled from the top of the cell and the cell sealed. The spin cell (G) was fitted at the bottom with the following screens (A) for dope filtration −2×20 mesh, 2×100 mesh, 1 "Dynalloy" (X5), 2×100 mesh and 2×50 mesh. The filtered dope then passed into a spinneret pack (B) containing the following complement of screens −1×100 mesh, 2×325 mesh, 2×100 mesh and a final 325 mesh screen fitted in the spinneret itself. Dopes were extruded through an air gap at a controlled rate into a static bath (C) using a Zenith metering pump to supply hydraulic pressure at piston D. The partially coagulated yarn was passed around a 9/16" diameter "Alsimag" pin, pulled through the bath, passed under a second pin and wound up. Yarn was washed continuously on the windup bobbin with water, extracted in water overnight to remove residual $HNO_3$ and subsequently air dried. The spinning parameters are given in Table 2.

lbs/in$^2$ (56.2 kg./cm.$^2$) typically attainable jet velocities on laboratory equipment were in the range of 15-50 ft/min (4.57-15.2 m/min). It was possible to increase jet velocity by localized warming at the spinneret (up to 40° C.). Liquid crystalline solutions may revert to an isotropic state when heated above a certain critical temperature and optimum spinnability and fiber tensile properties are obtained only below this temperature.

Filament tensile properties for as-spun cellulose triacetate are given in Table 3. In general, the filaments exhibit a slight yield at 1-2% elongation under tension after which the curve becomes essentially linear to failure. It should be noted that macroscopic defects in filaments can cause poorer tensile properties to be obtained even when satisfactory high molecular orientation is obtained. Spinning conditions can have an important effect on tensile properties, e.g., tenacity, on a microscopic scale. The effect of macroscopic defects can be detected by testing filaments at a number of different gauge lengths on the tensile tester.

Safety

Nitric acid is a strong oxidizer and caution must be excerised when it is in contact with organic matter. All triacetate spinning solutions were prepared with cooling to maintain temperatures at or below 30° C. Moderate heating at the spinneret during spinning at up to 40° C. was used occasionally to improve spinnability. As a safeguard against possible long term formation of cellulose nitrate, waste cellulose triacetate dopes in nitric acid were immediately suspended in water and disposed of.

Catalyst solutions containing perchloric acid, also a strong oxidizer, were kept dilute and maintained at low temperature prior to addition to the acetylation media.

TABLE 2

| Spin | Polymer | % Solids | Solvent mole ratio | $HNO^3$ (%) | Conc. Air gap (cm.) | Spinneret Hole Dia. (mm) | Spinneret No. of Holes | Bath Conc.* (%) | Bath Temp. (°C.) | Extrusion Rate (m/min) | Wind-Up Speed (m/min.) | Spin Stretch Factor |
|---|---|---|---|---|---|---|---|---|---|---|---|---|
| 1 | A | 40 | 2:1 | 87.5 | 0.64 | .0762 | 40 | 40 | −30 | 7.6 | 32.0 | 4.2 |
| 2 | B | 40 | 2:1 | 87.5 | 1.27 | .0762 | 40 | 40 | −50 | 6.4 | 24.4 | 3.8 |
| 3 | C | 40 | 2.6:1 | 90 | 1.27 | .1524 | 20 | 25 | −11 | 5.8 | 21.9 | 3.8 |
| 4 | B | 40 | 1.45:1 | 83.5 | 1.59 | .0762 | 40 | 40 | −35 | 4.6 | 18.3 | 4.0 |
| 5 | B | 35 | 2.3:1 | 89 | 0.64 | .0762 | 40 | 40 | −25 | 4.3 | 25.6 | 6.0 |
| 6 | D | 35 | 1.15:1 | 80 | 2.54 | .0762 | 40 | 40 | −25 | 12.0 | 34.7 | 2.9 |
| 7 | E | 38 | 2.6:1 | 90 | 1.27 | .0762 | 40 | 25 | −7 | 5.8 | 43.3 | 7.5 |
| 8 | B | 30 | 2:1 | 87.5 | 1.27 | .0762 | 40 | 40 | −15 | 19.5 | 39.0 | 2.0 |
| 9 | B | 30 | 0.86:1 | 75 | 0.64 | .0762 | 40 | 40 | −17 | 7.6 | 15.2 | 2.0 |
| 10 | B | 30 | 0.53:1 | 65 | (isotropic solution) | | | | | | | |
| 11 | B | 35 | — | 100 | (gel = would not extrude) | | | | | | | |

*Percent by volume methanol in water

TABLE 3

| Spin | Polymer | AACS | As-Spun T/E/M. (dN/tex /%/ dN/tex) |
|---|---|---|---|
| 1 | A | 200 | 10.8/8.1/157 |
| 2 | B | 154 | 9.1/7.3/168 |
| 3 | C | 118 | 8.3/9.3/118 |
| 4 | B | 190 | 8.2/8.5/140 |
| 5 | B | 172 | 8.4/7.1/156 |
| 6 | D | 125 | 8.2/7.2/130 |
| 7 | E | 137 | 5.7/5.3/152 |
| 8 | B | 130 | 5.1/7.2/120 |
| 9 | B | 90 | 4.9/8.8/90 |

Excellent fiber properties were realized with spin bath temperatures in the range of −10° C. to −50° C. and spin-stretch factors between 2.9-6.0 using cellulose triacetate derived from polymers A, B, C, and D of Table I. Good fiber properties might not be obtained if less than optimum spinning conditions are used. With the equipment used (maximum cell pressure=800

What is claimed is:

1. Process for preparing high strength cellulose triacetate fibers having at least 42.5% by weight acetyl groups by extruding a high solids, optically anisotropic solution of cellulose triacetate in a solvent mixture comprising nitric acid and another solvent having a molecular weight of less than 160 through an inert non-coagulating fluid layer into a coagulating bath wherein the cellulose triacetate has an inherent viscosity of at least 5 (0.5 g/dl in hexafluoroisopropanol at 30° C.), the polymer concentration is from about 30% to about 50% by weight, and the mol ratio of nitric acid to the other solvent is from about 1 to about 3.

2. Process of claim 1 wherein the other solvent is selected from the group consisting of water and methylene chloride.

3. Process of claim 2 wherein the other solvent is water, the mol ratio of nitric acid to water is 1.1 to 2.6 and the polymer concentration is 35–40% by weight.

4. Process of claim 2 wherein the coagulation bath is comprised of a 1–3 carbon atom alcohol or diol and water.

5. Process of claim 4 wherein the coagulating bath is comprised of methanol and water.

6. Process of claim 5 wherein the coagulating bath is comprised of from about 25 to about 50% methanol.

* * * * *